United States Patent [19]

Decaux

[11] 4,227,329

[45] Oct. 14, 1980

[54] SIGN POST

[76] Inventor: Jean-Claude Decaux, 53 Av. du Mal Lyautey, 75016 Paris, France

[21] Appl. No.: 956,377

[22] Filed: Oct. 31, 1978

[30] Foreign Application Priority Data

Dec. 7, 1977 [FR] France ..... 77 36825

[51] Int. Cl.[3] ..... G09F 15/00

[52] U.S. Cl. ..... 40/607

[58] Field of Search ..... 40/584, 606, 607

[56] References Cited

U.S. PATENT DOCUMENTS

| | | | |
|---|---|---|---|
| 1,944,498 | 1/1934 | Crick | 40/607 |
| 2,110,555 | 3/1938 | Pfaff | 40/607 |
| 2,507,875 | 5/1950 | Williams | 40/607 |
| 2,759,281 | 8/1956 | Akers | 40/607 |

*Primary Examiner*—Louis G. Mancene
*Assistant Examiner*—Wenceslao J. Contreas
*Attorney, Agent, or Firm*—Kenyon & Kenyon

[57] ABSTRACT

The sign post comprises a supporting tube and one or more sign box structures which may or may not be illuminated for providing information to the public, in particular in a town zone. In this sign post, the box structure comprises at least two half-shells which are detachably assembled and the assembly faces of the two half-shells have complementary recesses for the passage of the supporting tube.

This type of sign post is particularly applicable in road sign systems.

4 Claims, 1 Drawing Figure

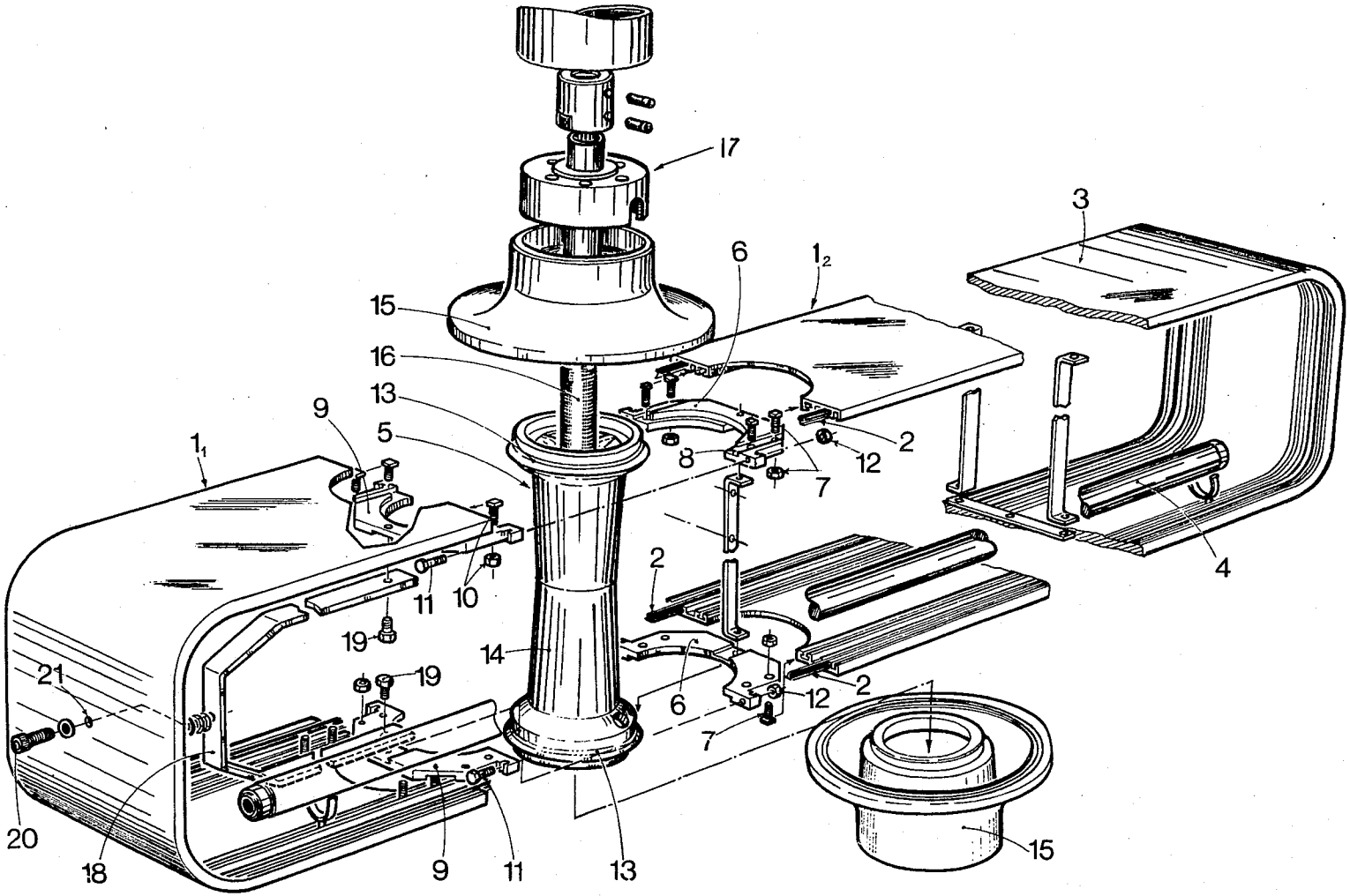
3
4
15
1
2
12
7
1₂
6
17
8
2
13
14
11
10
9
19
15
16
13
5
9
1₁
18
21
20

SIGN POST

The invention relates to a sign post comprising a supporting tube and one or more sign boxes which may be illuminated for providing information to the public, particularly in a town area.

Sign posts of this type are already known (see in this respect Applicant's French Pat. No. 74 25 356 of July 22, 1974) and comprise a supporting tube anchored in the ground and carrying at least one box structure comprising a rigid frame supporting a case whose lateral walls are translucent to the light from inner illuminating means.

In this type of post, the box structure is usually constructed as a single unit and the supporting tube extends through this box structure owing to the provision of apertures in the lower and upper walls of the case of the box structure.

Notwithstanding the fact that the case is sometimes constructed in a plurality of parts as in the structure disclosed in U.S. Pat. No. 74 25 356, the dismounting of the box structure for withdrawing it from the supporting tube can only be achieved by sliding the box structure toward the top of the tube until the box structure can be completely disengaged from the tube. In the case of a box structure case which is in a plurality of parts, it is merely possible to have access to the interior of the box structure for replacing defective members or means, and this multipart structure of the case does not allow the dismounting of the box structure in a manner other than by sliding the box structure toward the top of the tube, since the frame of the box structure is in one piece.

Thus, in the event of damage to the box structure, for example, owing to a sudden shock produced by a traffic accident (which may be relatively frequent, since the sign posts are located in automobile traffic zones and at crossroads), the means fixing the box structure must be dismounted and withdrawn and then the box structure must be disengaged from the top of the tube, which constitutes a considerable drawback, in particular when the post supports a plurality of box structures and it is the lowermost box structure which must be changed. This drawback also exists when it is desired to add to an existing post a new sign box structure, and in particular when the new box structure must be positioned below the originally-mounted box structures, since in this case all the existing box structures must be dismounted to allow the passage of the additional box structure.

Further, in this type of sign post, it is difficult, unless, here again, many disassembling operations are carried out, to modify the positions of the box structures relative to the tube by an angular displacement of the box structures relative to the latter.

It is consequently an object of the invention to overcome these drawbacks and to provide for this purpose a sign post of the type comprising a supporting tube which extends through at least one sign box structure disposed transversely of the tube, wherein the box structure comprises at least two half-shells which are detachably assembled, the assembling faces of these half-shells having complementary recesses for the passage of the supporting tube.

According to the invention, the tube may have a polygonal or circular cross-sectional shape and, in the latter case, the recesses in the assembling faces of the two half-shells forming the box structure are semi-circular in order to fit round the tube.

According to a feature of the invention, and in the case where the tube has a circular cross-sectional shape, the joint plane of the two half-shells is transverse to the box structure and coincides with the axis of the cylindrical tube.

A sign post according to the invention is shown by way of a non-limitative embodiment in the accompanying single FIGURE which is an exploded perspective view of the box structure and the upper part of the supporting tube.

The manner of assembling and fixing the box structure to the supporting tube may of course be applied to structures completely different from that illustrated in the accompanying drawing which merely constitutes one possible example of application.

The box structure comprises two half-shells $1_1 1_2$ which mayhave the same dimensions. However, in the considered embodiment, they have different volumes, the smaller half-shell $1_1$ constituting the part of the box structure which is dismountable from the tube.

Each half-shell comprises a frame 2 and a covering case 3 which is closed laterally by translucent or transparent side walls which allow to show through, if necessary, the light from inner illuminating means, such as fluorescent tubes 4.

The frame is in the form of hairpin-shaped section members and the case has internal grooves in which the section members are inserted for stiffening this case.

The joint plane of the two half-shells contains the axis of the supporting tube 5 and the assembling faces of the box structure fit around the tube. If it concerns tubes having a cross-sectional shape other than circular, the joint plane of the two half-shells may be offset relative to the axis of the tube.

The half-shell $1_2$ comprises adjacent its assembling face two semicircular half-rings 6 which are permanently fixed to the section members 2 of the frame by nuts and screws 7, the projecting end of the section members 2 extending into grooves 8 extending through the half-rings. The half-shell $1_1$ also has two assembly half-rings 9 which are also fixed to the section members of the frame by nuts and screws 10, the half-rings 6 and 9 of the two half-shells being assembled in edge-to-edge abutment by screws 11 and lock-nuts 12.

When the two half-shells are to be assembled, the half-rings, which are respectively rigid with their half-shells, are made to bear on annular shoulders 13 provided on the supporting tube 5.

In the considered embodiment, this tube comprises a sleeve 14 having a height equal to that of the box structure so as to constitute a spacer member, the annular shoulders 13 axially facing the assemblinghalf-rings 6 and 9 so that the latter can bear against these shoulders.

Applied against the upper and lower faces of the box structure are two collars 15 which are held in position by a screw threaded rod 16 and a locking device 17.

The case of the half-shell $1_1$ comprises a U-shaped member 18 assembled with the half-rings 9 by screws 19 and with the case by an end screw 20 extending through an orifice in the case.

This assembly allows access to the interior of the box structure merely by removing the case of the half-shell $1_1$ by unscrewing the screw 20 and withdrawing the case, the half-rings 9 remaining coupled with the two half-rings 6 and the U-shaped member 18 remaining associated with the half-rings 9. The removal of the case of the half-shell $1_1$ consequently permits the cleaning of the interior of the box structure with possibility of replacement of defective components, for example the illuminating means.

After withdrawal of the case of the half-shell $1_1$, the complete disassembly of the box structure is possible merely by unscrewing the assembling screws of the two sets of half-rings 6 and 9. If it is merely desired to modify the orientation of the box structure with respect to the tube, the screws 11 are slightly unscrewed so as to loosen the gripping action the half-rings have on the tube and thereby enable the box structure to turn freely on the tube 5.

This assembly has the big advantage of allowing the dismounting of the box structure in a lateral direction and not by an upward displacement along the tube, as effected in the prior art.

Now this design is particularly advantageous since it enables a box structure to be completely replaced or allows access to the interior of the box structure with no need to dismount superimposed box structures if the tube is provided with a plurality of box structures in stacked relation to each other.

As mentioned before, the invention is not intended to be limited to this embodiment, since this manner of assembling may be applied to box structures of different design, with or without internal illumination, without departing from the scope of the invention defined in the accompanying claims.

Further, this manner of assembling may be adopted for supporting tubes of different design, whether of circular or non-circular cross-sectional shape, without changing the general principle described hereinbefore and defined in the claims.

I claim:

1. In a sign post comprising a supporting tube structure having a longitudinal axis, at least an elongated box structure which comprises a first half-shell and a second half-shell, the half-shells being engaged with the tube structure on opposite sides of the tube structure and having a joint line substantially contained in a plane which contains said axis and is transverse to the length of the box structure, first half-rings associated with the first half-shell and second half-rings associated with the second half-shell, first fixing means fixing the first half-rings to the first half-shell, second fixing means fixing the second half-rings to the second half-shell, and third fixing means fixing the first half-rings to the second half-rings to form substantially a ring unit gripping the tube structure and holding the box structure in position on the tube structure; the improvement wherein said first means are releasable from outside the box structure, said first half-rings and second half-rings are engaged with the tube structure on opposite sides of said plane and are shaped and disposed to be withdrawable from the tube structure transversely of said plane, said third fixing means are releasable laterally of said axis and accessible from the side of said plane adjacent to the first half-shell and the tube structure has at least an upwardly facing abutment surface against which surface first and second half-rings bear axially downwardly of the tube structure.

2. A sign post as claimed in claim 1, wherein the two half-shells have unequal lengths and a substantially U-shaped member slidably supports the smaller first half-shell, the U-shaped member being connected by detachable fixing means to the first half-rings.

3. A sign post as claimed in claim 1, wherein the supporting tube structure comprises a centering sleeve provided with two annular shoulders on which are centered the half-rings for clamping the box structure in position, collars holding stationary upper and lower walls of the box structure between the sleeve and the collars, the collars being located on opposite sides of the box structure and a screw-threaded rod which extends through the sleeve and interconnects the collars.

4. A sign post as claimed in claim 1, 2 or 3, wherein the supporting tube structure receives a plurality of box structures.

* * * * *